US005248549A

United States Patent [19]

Silva et al.

[11] Patent Number: 5,248,549

[45] Date of Patent: Sep. 28, 1993

[54] CONCRETE PANELS WITH CONTINUOUS ELONGATED MEMBERS

[76] Inventors: Felipe Silva; Christian Fieve, both of 235 SW. Le Jeune Rd., Miami, Fla. 33134

[21] Appl. No.: 884,133

[22] Filed: May 18, 1992

[51] Int. Cl.[5] ..... B32B 9/00

[52] U.S. Cl. ..... 428/255; 52/600; 52/601; 52/659; 52/309.17; 428/192; 428/414; 428/413; 428/454

[58] Field of Search ..... 52/600, 601, 659; 428/255, 192, 414, 413, 454

[56] References Cited

U.S. PATENT DOCUMENTS 3,949,144 4/1976 Duff ..... 428/414

4,133,928 1/1979 Riley et al. ..... 428/255

*Primary Examiner*—Patrick J. Ryan
*Assistant Examiner*—Abraham Bahta
*Attorney, Agent, or Firm*—J. Sanchelima

[57] ABSTRACT

A panel having several concrete layers and further including a sufficient number of elongated members disposed between the adjacent layers so that the brittle characteristics of the concrete panel are minimized. Inexpensive spacing material is provided to minimize the use of concrete, maintain the weight low and improve its handling characteristics. Utility conduits are provided built in as typically found in building structures as well as reinforcing bars as the architectural design requires. The panels are designed for their ready assembly on site.

10 Claims, 3 Drawing Sheets

CONCRETE PANELS WITH CONTINUOUS ELONGATED MEMBERS

BACKGROUND OF THE INVENTION

1. Field of the Invention

The present invention relates to concrete panels for prefabricated structures, and more particularly, to such panels that include longitudinally extending elongated members disposed within said concrete panels.

2. Description of the Related Art

Applicant believes that the closest reference corresponds to U.S. Pat. No. 3,949,144 issued to Duff on Apr. 6, 1976. However, it differs from the present invention because it discloses the use of chopped epoxy or other resin particles and not the use of continuous elongated members, as it is disclosed herein and claimed. Also, other characteristics of the present invention as claimed differentiate the physical structure of the present invention as an article of manufacture to the structure and purpose of the cited patent.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a concrete panel that includes continuous elongated members longitudinally and/or transversally disposed along substantially the entire length and width of said panels in order to improve the mechanical qualities of the panel in order to minimize the width, and consequently the amount, of the concrete used.

It is another object of this invention to provide a concrete panel that can be readily assembled to other similar and cooperating panels to manufacture a structure at the site.

It is still another object of the present invention to provide a concrete panel that can be transported with relatively ease and sturdy enough to withstand the stresses associated with transportation.

It is yet another object of the present invention to provide a concrete panel that includes the utility conduits required in typical building structures.

Another object of this invention is to provide such a device that is inexpensive to manufacture and maintain while retaining its effectiveness. Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
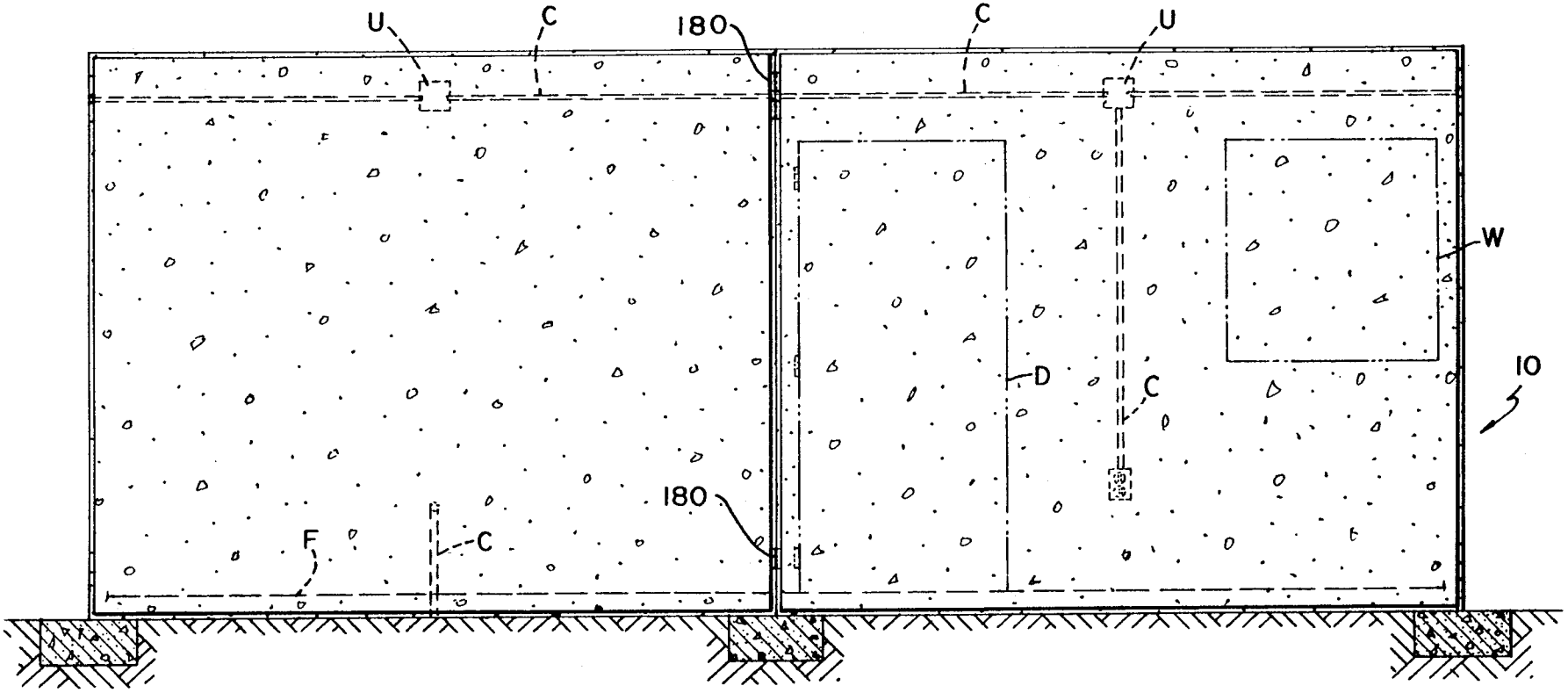
FIG. 1 represents two adjacent panels, welded together, according to the present invention.

Referring now to FIG. 1, where the present invention is generally referred to with numeral 10, it can be observed that two adjacent concrete panels are welded together in a typical application for the construction of a building structure. The location of openings for windows W and doors D can be changed depending on the architectural designs. Floor F is preferably poured after panels 10 are erected in place. The panels are welded together at the site where the structure will be erected.

Figure 2:
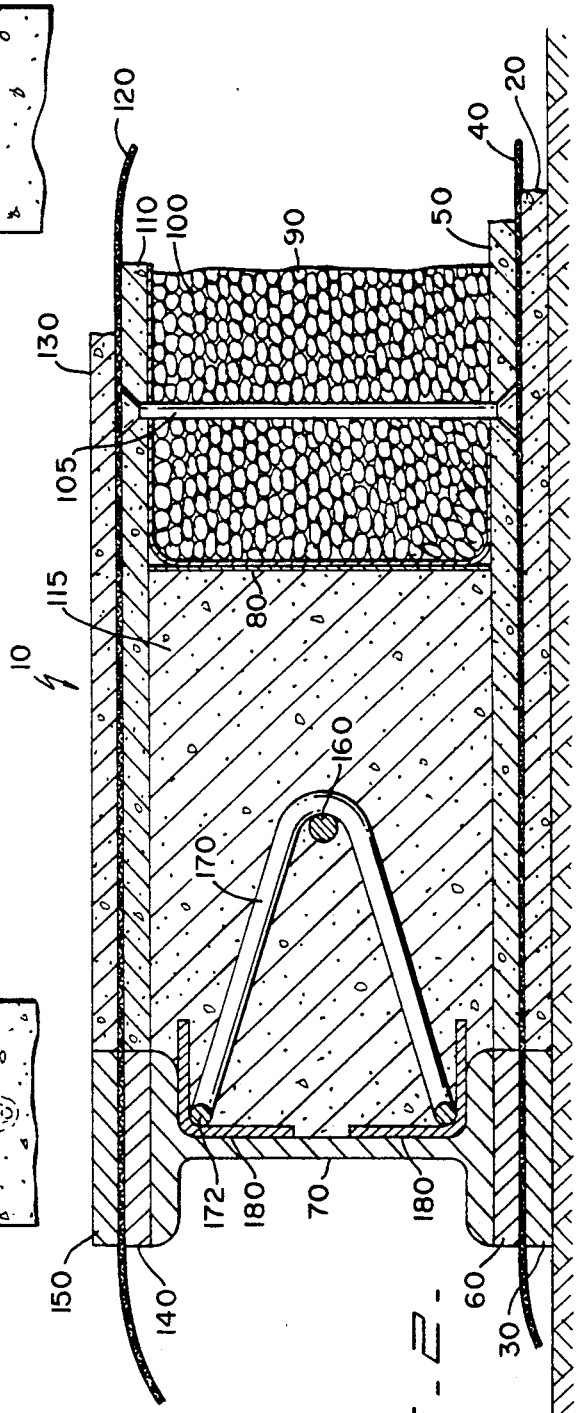
FIG. 2 shows a partial cross-section of the edge of the panel and also shows some of the members used in the preferred process for manufacturing the panel.

In FIG. 2, it can be observed that the panels are manufactured, in the preferred embodiment, by pouring a first layer 20 of concrete inside form member 30 and subsequently, a number of elongated members 40 are positioned over layer 20. The concrete used should be of the fine granular type. Then, second layer 50 of concrete is poured and kept within a predetermined area by forming member 60 which is preferably mounted to the bottom of I-beam member 70. Removable retainer members 80 are longitudinally placed inside panel 10, resting on second layer 50. The purpose of removable retainer members 80 is to keep compacted spacing material 90 within a predetermined space 100. This will permit substantial savings in the amount of concrete used and at the same time will reduce the weight of the panels. Space members 105 are used throughout panel 10 to provide necessary support. In the preferred embodiment, plant material has been utilized as spacing material 90. Depending on the geographic area where the invention is to be used, different materials can be utilized. In Venezuela, for instance, the skin of the rice grain has been used. Other plant fibers can also be used, or even newspaper. The least expensive material 90 should be used. It is important to empirically determine how much spacing material 90 will be compressed with a given amount of concrete poured above it. In the case of rice grain skin, it has been found that for each 8 centimeters of this spacing material it will compress 1 centimeter. Therefore, about 1 centimeter above the intended final level of third layer 110 should be poured when rice skin is used as spacing material 90. Then, additional elongated members 120 are placed above third layer of concrete 110 and finally, the last and fourth layer 130 of concrete is poured. Cavity 115 is then poured. The upper part of I-beam 70 has forming member 140 mounted thereon and forming member 150 removably placed on forming member 140.

Bar member 160 extends longitudinally and comes in contact with hook member 170. L-Shape angle member 180 is preferably soldered to the ends 172 of hook member 170. Members 160; 170, and 180 are made out of steel. L-shape angle members 180 extend a sufficient distance to provide an exposed cooperative surface that are at the edges of panels 10 so that they can be welded together with adjacent panels in a structure.

It has been found that the use of elongated members 40 and 120 reinforce the mechanical characteristics of the adjacent layers of concrete. Otherwise, the adjacent layers are brittle and cannot withstand the stress normally found in transportation, thermic shock and load stresses in general. Preferably, the elongated members 40 and 120 are made out of continuous fibers of polypropylene for applications such as the construction of low cost dwellings where traction stresses are not significant. Other elongated members used have been fiberglass, steel wire, cotton strands, etc. Also, the disposition of the elongated members can be in criss-cross, such as wire mesh.

Figure 4:
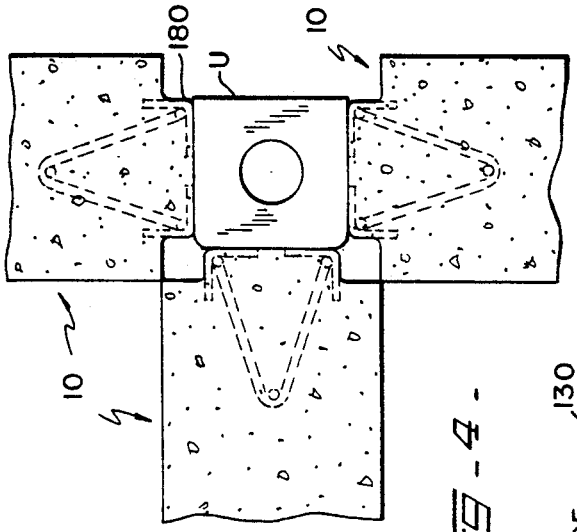
FIG. 4 is similar to FIG. 3 except that it also shows an electrical utilities box.
Figure 3:
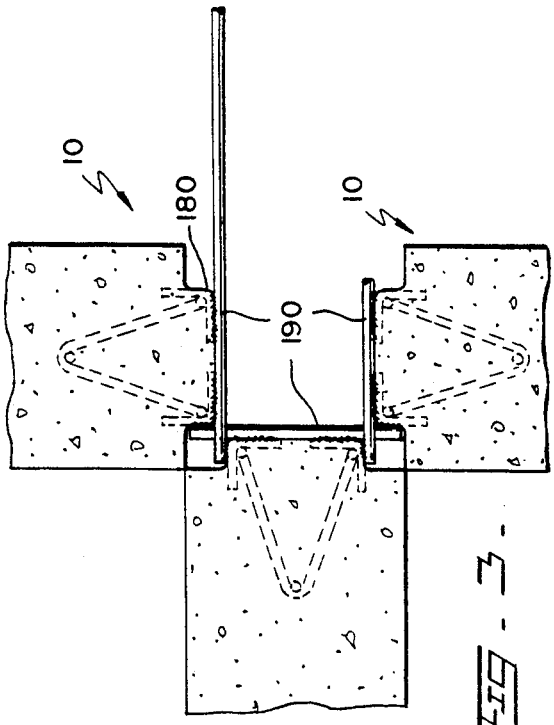
FIG. 3 illustrates is a top view of a portion of three coinciding panels.

In FIG. 3, the ends of three panels converge showing the preferred manner of anchoraging them together. At another point along the converging ends of the three panels shown in FIG. 3, it is possible to position a utility box U as shown in FIG. 4. Bar members 190 are preferably used to provide welded interlocking anchorage for the structure being erected depending on its needs.

Figure 5:
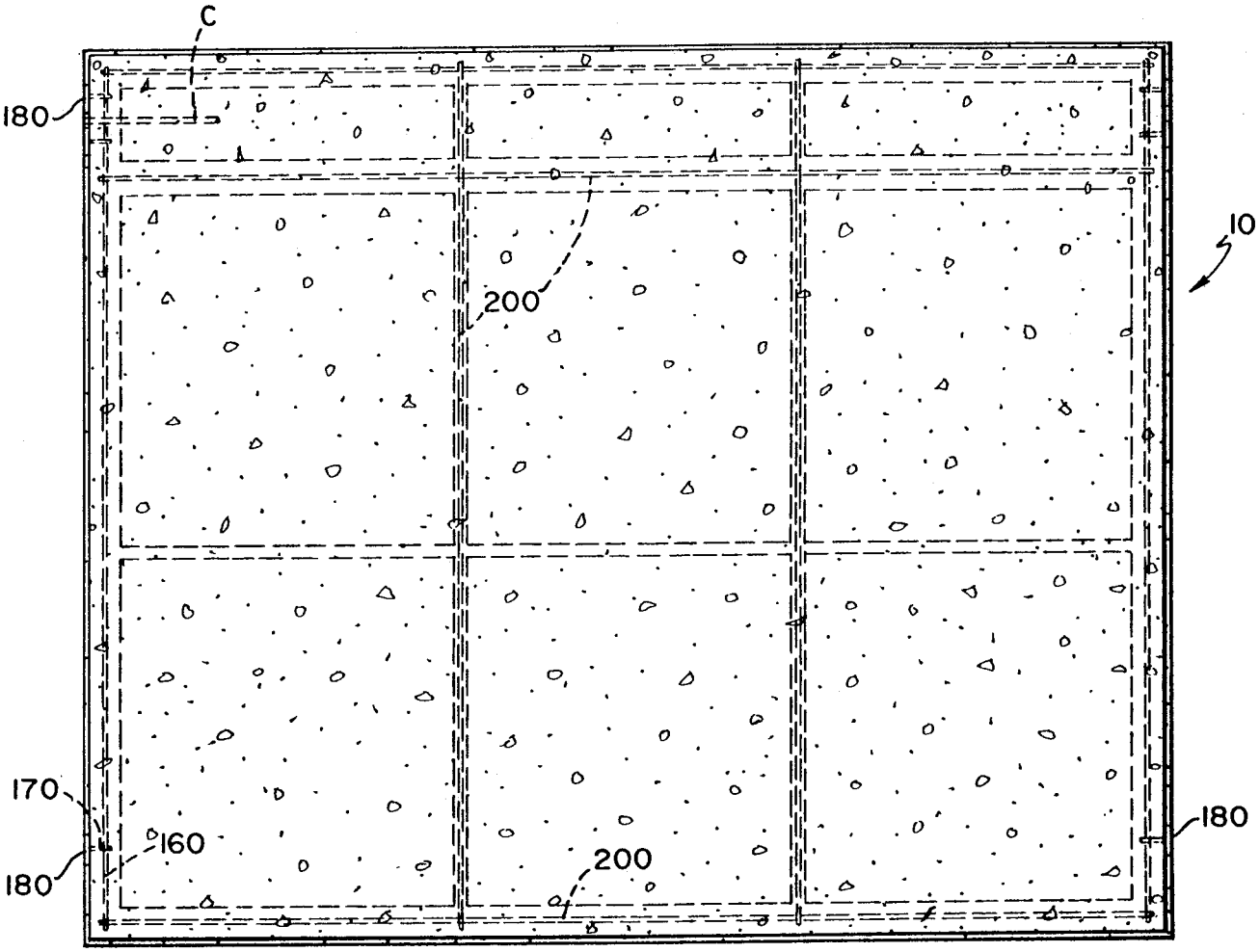
FIG. 5 shows a typical panel.

In FIG. 5, panel 10 incorporating the features of the present invention are shown. Exposed L-shape angle members 180 are included on both lateral edges and bar member 160 can be seen in dotted as well as hook member 170. Structural reinforcing rods 200 are positioned at predetermined spaced apart distances depending on the application intended for the panel. Also, electrical, telephone and cable conducts C can also be cooperatively placed inside panel 10 prior to pouring it.

The foregoing description conveys the best understanding of the objects and advantages of the present invention. Different embodiments may be made of the inventive concept of this invention. It is to be understood that all matter disclosed herein is to be interpreted merely as illustrative, and not in a limiting sense.

What is claimed is:

1. A rectangular panel having a peripheral edge comprising at least two pairs of fine granular concrete layers and each pair having two abutting fine concrete layers sandwiching a plurality of elongated fiber members, and wherein said pairs of fine granular concrete layers are kept in a parallel spaced apart relationship to each other by a poured cavity formed adjacent to the edge of said panel and thereby defining a space between said pairs of fine granular concrete layers is filled with a spacing material.

2. The panel set forth in claim 1 wherein said spacing material is in compressed state.

3. The panel set forth in claim 2 further including at least two metal L-shape angle plates mounted inside said poured cavity and having a protruding and exposed flat surface and said flat surfaces being cooperatively positioned to match similar metal plates of similar panels so that said similar panels can be rigidly joined together through the soldering of said exposed surfaces.

4. The panel set forth in claim 3 further including longitudinally extending bar members positioned within said poured cavity and hook means cooperative engaged to said bar members and rigidly mounted to said metal L-shape angle plates to keep the latter structurally in place.

5. The panel set forth in claim 4 wherein said spacing material includes grain skin.

6. The panel set forth in claim 5 wherein said grain skin includes rice skin.

7. The panel set forth in claim 1 wherein said elongated members include continuous fibers of polypropylene.

8. The panel set forth in claim 1 wherein said elongated members include continuous fibers of fiberglass.

9. The panel set forth in claim 1 wherein paid elongated members include continuous fibers of steel wire.

10. The panel set forth in claim 1 wherein said elongated members include cotton strands.

* * * * *